US006553125B2

(12) United States Patent
Kobayashi et al.

(10) Patent No.: US 6,553,125 B2
(45) Date of Patent: Apr. 22, 2003

(54) MULTIPLE-FUNCTION CONVERTOR FOR CONVERTING ELECTRIC SIGNALS TO VIBRATION OF ELEMENTS OF A PORTABLE ELECTRONIC INSTRUMENT

(75) Inventors: Takashi Kobayashi, Yamanashi-ken (JP); Akira Yoneyama, Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 153 days.

(21) Appl. No.: 09/836,246

(22) Filed: Apr. 18, 2001

(65) Prior Publication Data

US 2002/0051557 A1 May 2, 2002

(30) Foreign Application Priority Data

Apr. 21, 2000 (JP) ..... 2000-121852

(51) Int. Cl.[7] ..... H04R 25/00

(52) U.S. Cl. ..... 381/396; 381/401; 381/424; 381/431

(58) Field of Search ..... 381/150, 396, 381/398, 400, 401, 402, 403, 406, 407, 412, 416, 420, 424, 431; 340/388.1, 388.2, 407.1

(56) References Cited

U.S. PATENT DOCUMENTS 6,211,775 B1 * 4/2001 Lee et al. ..... 381/396
6,373,956 B1 * 4/2002 Enomoto et al. ..... 381/396

* cited by examiner

*Primary Examiner*—Binh Tieu
*Assistant Examiner*—Suhan Ni
(74) *Attorney, Agent, or Firm*—Dennison, Schultz & Dougherty

(57) ABSTRACT

A vibrating plate is mounted in a case, and a first coil is secured to the vibrating plate. A magnetic circuit composition is mounted in the case. The magnetic circuit composition comprises a yoke having a flange and a core formed on the flange, an annular magnet mounted on the flange of the yoke, and a top plate comprising an annular portion and a cylindrical portion projection from a peripheral portion of the annular portion. The magnetic circuit composition is resiliently supported in the case. A coil holding plate is secured to the case, and a second coil is secured to the coil holding plate. The first coil is inserted in a first magnetic gap formed in the magnetic circuit composition and the second coil is inserted in a second magnetic gap formed in the magnetic circuit composition.

7 Claims, 2 Drawing Sheets

MULTIPLE-FUNCTION CONVERTOR FOR CONVERTING ELECTRIC SIGNALS TO VIBRATION OF ELEMENTS OF A PORTABLE ELECTRONIC INSTRUMENT

BACKGROUND OF THE INVENTION

The present invention relates to a multiple-function convertor for converting electric signals to vibration of vibrating plates mounted in a case of a portable instrument such as the portable telephone and the beeper, and more particularly to a convertor for converting electric input signals to vibration of a vibrating plate to generate sounds and to vibrate the case of the portable instrument to inform the user of the instrument about the receiving of calling signals.

In recent years, there is provided a portable telephone having a multiple-function convertor for vibrating a vibrating plate to generate sounds, and to further generate voices of the caller. Therefore, such a multiple-function convertor can be used in the hands free operation in which the vibration plate is operated as a speaker for the voice of the caller and as a microphone for the voice of the user.

FIG. 3 is a plan view showing a conventional multiple-function convertor in which a vibrating plate is removed in order to show an internal composition, and FIG. 4 is a sectional view taken along a line IV-IV of FIG. 3.

Referring to FIG. 3, the multiple-function convertor comprises a case 1, and a magnetic circuit composition 8 provided in the case 1. The magnetic circuit composition 8 comprises a yoke 4, a magnet 5 mounted on the yoke 4 and a top plate 6.

The yoke 4 is supported by an annular supporting spring plate 7. The supporting spring plate 7 comprises an outer annular plate 7*a*, an inner annular plate 7*b* and connecting plates 7*c* connecting both plate 7*a* and 7*b* with each other. The inner annular plate 7*b* is fixed to a top of a cylindrical projection 4*a* of the yoke 4 by welding, and the outer annular plate 7*a* is embedded in an inside annular projection la of the case 1. Thus, the magnetic circuit composition 8 is hung in the case 1 and resiliently supported by the connecting plates 7*c*. A vibrating plate 2 made of plastic is secured to the annular projection 1*a* of the case 1 by an adhesive at a periphery thereof. An annular voice coil 3 is secured to the underside of the vibrating plate 2. The voice coil 3 is disposed in an annular magnetic gap 9 formed between the cylindrical projection 4*a* and the top plate 6.

When an alternating current driving signal is applied to the voice coil 3, an alternating electromagnetic force generates between the voice coil 3 and the magnetic circuit composition 8.

When the frequency of the driving signal is high and in the range of the audio frequency, the vibrating plate 2 is vibrated to generate sounds such as beeping sounds or voices. On the other hand, the magnetic circuit composition 8 supported by the supporting spring plate 7 does not vibrate since the magnetic circuit composition has a small natural frequency.

To the contrary, when the frequency of the driving signal is low and in a frequency range lower than the audio frequency, the vibrating plate 2 does not so largely vibrate as to generate sounds, and the magnetic circuit composition 8 vibrates without generating sounds. The vibration of the magnetic circuit composition 8 is transmitted to the body of the portable instrument through the case 1, thereby informing the user of the instrument about the receiving of calling signals by the vibration.

In the case that the magnetic circuit composition 8 vibrates at a low frequency signal, it may occur that the vibrating plate 2 approaches to the magnetic circuit composition during the vibrating of the vibrating plate 2 and collides with the magnetic circuit composition 8, which may generate abnormal sounds and cause parts of the convertor to deform and break.

In order to prevent such troubles from occurring, it is necessary to increase the gap between the vibrating plate 2 and the magnetic circuit composition 8, which means that the thickness of the convertor can not be reduced more than a certain limitation.

In addition, the operation of the convertor is either of the sound generating vibration and vibration without sound, and both vibrating operations cannot be carried out at the same time.

SUMMARY OF THE INVENTION

An object of the present invention is to provide a multiple-function convertor which can be reduced in thickness without causing collision between members therein.

Another object of the present invention is to provide a multiple-function convertor which can be operated to generate sounds and vibration of instruments at the same time.

According to the present invention, there is provided a multiple-function convertor for a portable electronic instrument, comprising a case for mounting components of the electronic instrument, a vibrating plate securely mounted in the case at one of axial ends of the case, an annular first coil secured to the vibrating plate, a magnetic circuit composition mounted in the case, the magnetic circuit composition comprising a yoke having a flange and a core formed on the flange, an annular magnet mounted on the flange of the yoke at one of magnetic poles thereof, and a top plate comprising an annular portion and a cylindrical portion projected from a peripheral portion of the annular portion, the annular portion being engaged with the other magnetic pole of the magnet, supporting means for resiliently supporting the magnetic circuit composition in the case, a coil holding plate secured to the case at the other axial end of the case, an annular second coil secured to the coil holding plate, the first coil being inserted in a first magnetic gap formed in the magnetic circuit composition at one of axial end sides thereof, and the second coil being inserted in a second magnetic gap formed in the magnetic circuit composition at the other axial end side thereof, and means for independently applying electric exciting current to the first coil and second coil.

The cylindrical portion of the top plate is provided for surrounding the periphery of the magnet.

The supporting means comprises a pair of annular supporting spring plates one of which is secured between a base of the cylindrical portion of the top plate and the case, and the other of which is secured between an end portion of the cylindrical portion and the case.

These and other objects and features of the present invention will become more apparent from the following detailed description with reference to the accompanying drawings.

DETAILED DESCRIPTION OF THE PREFERRED EMBODIMENT

Figure 1:
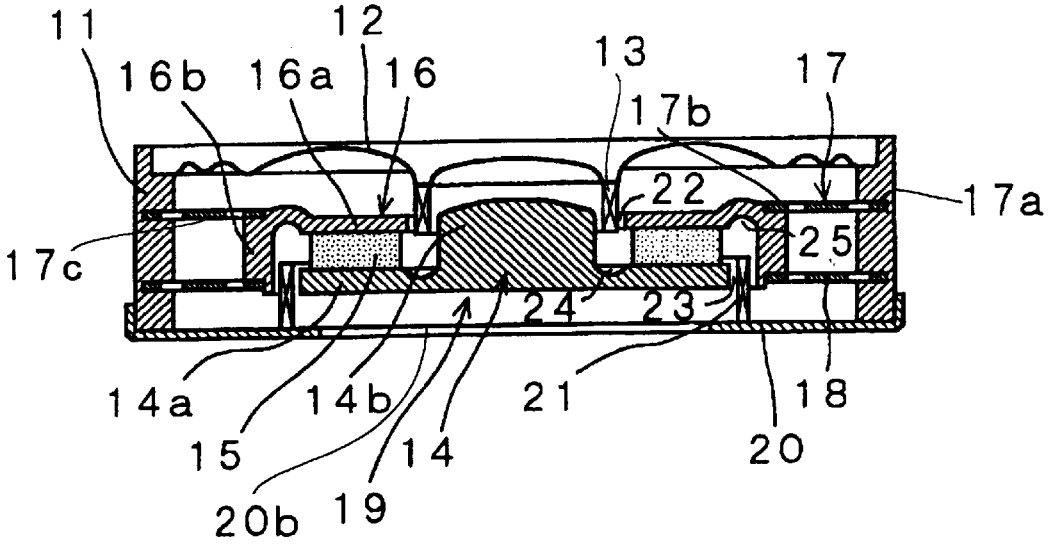
FIG. 1 is a sectional view showing a first embodiment of the present invention.

Referring to FIG. 1 showing the first embodiment of the present invention, the multiple-function convertor of the present invention comprises a case 11 made of plastic, and a magnetic circuit composition 19 provided in the case 11. The magnetic circuit composition 19 comprises a yoke 14 comprising a flange 14*a* and a core 14*b* , an annular magnet 15 mounted on the yoke 14 at one of magnetic poles thereof, and a top plate 16. The top plate 16 comprises an annular portion 16*a* and a downwardly projected cylindrical portion 16*b*. The yoke 14, magnet 15 and the top plate 16 are fixed with each other by adhesives.

Figure 3:
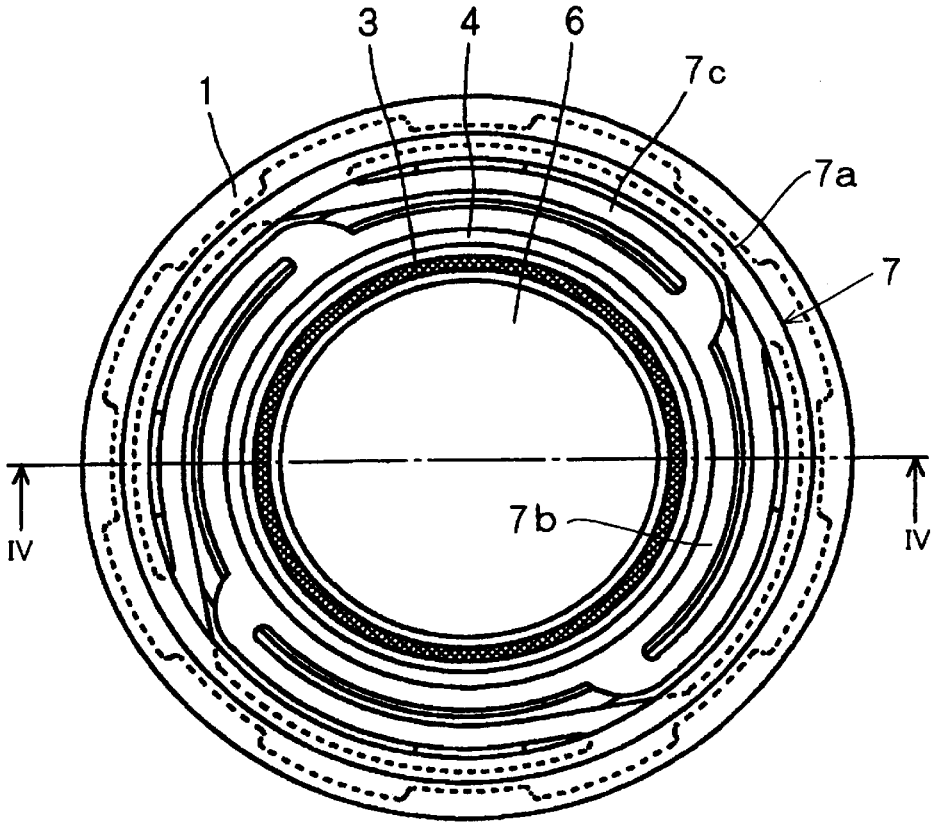
FIG. 3 PRIOR ART
FIG. 3 is a plan view showing a conventional multiple-function convertor.
Figure 4:
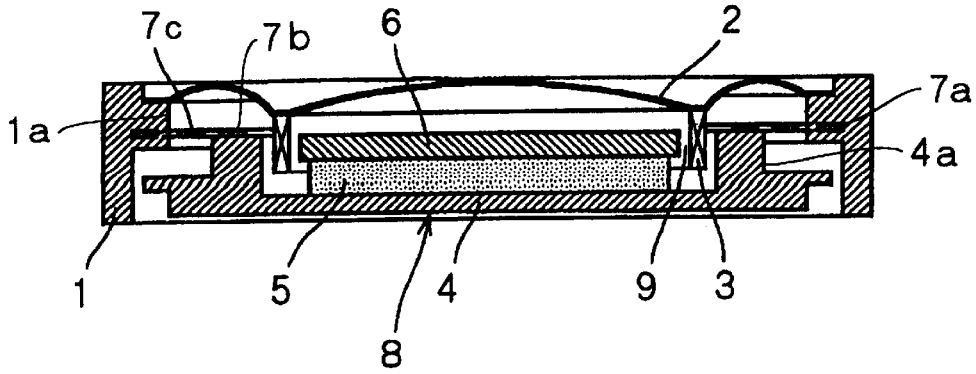
FIG. 4 PRIOR ART
FIG. 4 is a sectional view taken along a line IV-IV of FIG. 3.

The annular portion 16*a* of the top plate 16 is mounted on the other magnetic pole of the magnet 15. The top plate 16 is supported by a pair of annular supporting spring plates 17 and 18 which are the same construction as the spring plate 7 of FIG. 3. Namely each of the supporting spring plates 17 and 18 comprises an outer annular plate 17*a*, an inner annular plate 17*b* and connecting plates 17*c* connecting both plates 17*a* and 17*b* with each other. Both of the inner annular plates 17*b* are fixed to an upper surface and lower surface of the cylindrical portion 16*b* of the top plate 16 by welding, and the outer annular plates 17*a* are embedded in an inside wall of the case 11. Thus, the magnetic circuit composition 19 is hiding in the case 11 and resiliently supported by the connecting plates 17*c*. The connecting plates 17*c* of both spring plates 17 and 18 are shifted half pitch, thereby uniforming spring characteristics.

A vibrating plate 12 made of plastic is secured to the upper periphery of the case 11 by an adhesive. An annular voice coil 13 is secured to the underside of the vibrating plate 12 and disposed in a first magnetic gap 22 between the inside periphery of the annular portion 16*a* of the top plate 16 and the core 14*b* of the yoke 14.

A coil holding plate 20 made of plastic is secured to the underside of the case 11 by an adhesive. An exciting coil 21 is secured on the coil holding plate 20 and disposed in a second magnetic gap 23 formed between the inside wall of the cylindrical portion 16*b* of the top plate 16 and the outer periphery of the flange 14*a* of the yoke 14.

The coil holding plate 20 has a large stiffness so as not to be vibrated by the electromagnetic force in the second magnetic gap 23.

Annular recesses 24 and 25 are formed in the flange 14*a* of the yoke 14 and in the annular portion 16*a* of the top plate 16 so as to avoid contact with coils 13 and 21.

The magnetic circuit composition 19 is provided to have a resonance frequently lower than the audio frequency. Namely, the magnetic circuit composition 19 and the supporting spring plates 17 and 18 are composed so that the composition 19 is vibrated at a frequency in a frequency range lower than the audio frequency without generating sounds or with faint sounds. In other words, the magnetic circuit composition 19 and supporting spring plates 17 and 18 are composed as a vibrator.

When an alternating current driving signal is applied to the voice coil 13, an alternating electromagnetic force generates between the voice coil 13 and the magnetic circuit composition 19.

When the frequency of the driving signal is high and in the audio frequency the vibrating plate 12 is vibrated to generate sounds such as beeping sounds or voices. On the other hand, the magnetic circuit composition 19 supported by the supporting spring plates 17 and 18 does not vibrate since the magnetic circuit composition has a resonance largely lower than the driving signal and has a heavy weight.

Therefore, the vibrating plate 12 and the magnetic circuit composition 19 do not collide with each other.

When a driving signal having a frequency in a frequency range lower than the audio frequency is applied to the exciting coil 21, only the magnetic circuit composition 19 is vibrated. At that time, the exciting coil 21 does not vibrate since the coil is mounted on the steady holding plate 20.

The vibration of the magnetic circuit composition 19 is transmitted to the body of the portable instrument through the case 11, thereby informing the user of the instrument about the receiving of calling signals by the vibration. Namely, in accordance with the present invention, the magnet circuit composition 19 is driven by driving force so that the vibration thereof is transmitted to the body of the portable instrument.

Since the coil 21 is steadily held by the holding plate 20, the vibration energy is effectively converted to the vibration of the magnetic circuit composition 19 so that the composition 19 is powerfully driven.

In the above described embodiment, when the drive signal is applied to the coil 21 for vibrating the magnetic circuit composition 19, the driving signal is not applied to the coil 13 by changing-over the driving signal circuit to the coil 21. As a modification of the embodiment, it is possible to prevent the driving signal from applying to the coil 13 by setting inputs of the coil 13 to a high impedance.

As another example, when one of the coils 13 and 21 is excited, the other coil is used as a detecting coil, and a detected signal is fed back to the driving signal to perform the oscillation of the exciting coil.

Since the cylindrical portion 16*b* of top plate 16 is positioned at the outer position of the magnet 15, the cylindrical portion 16*b* has effect on preventing of the leakage of the magnetic flux.

Figure 2:
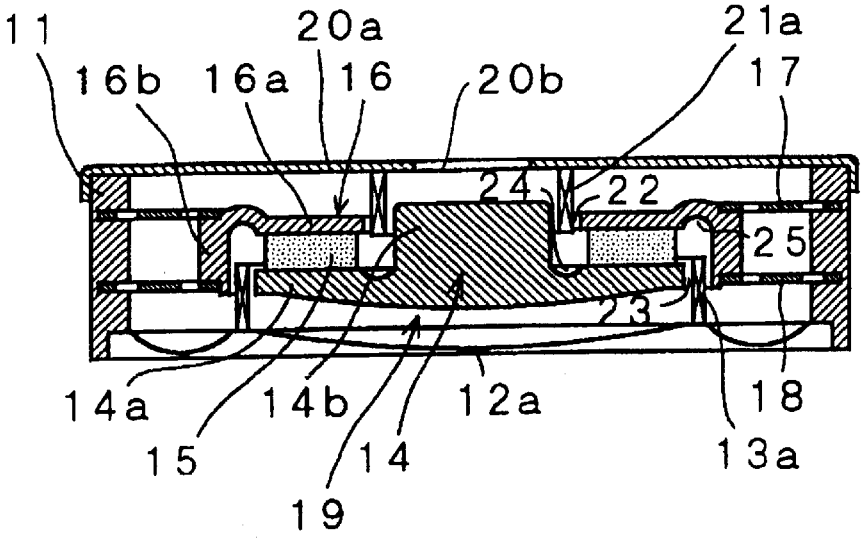
FIG. 2 is a sectional view showing a second embodiment of the present invention.

Referring to FIG. 2 showing the second embodiment of the present invention, relative positions of the voice coil 13 and the exciting coil 21 to the magnet 15 in the first embodiment are reversed. Namely, a voice coil 13*a* is located outside the magnet 15, and an exciting coil 21*a* is located inside the magnet. Hence, a vibrating plate 12*a* and a holding plate 20*a* are also reversed in position. Other parts are the same as the first embodiment and are identified by the same reference numerals as FIG. 1.

The top of the core 14*b* of the yoke 14 in FIG. 1 has a spherical shape corresponding to the spherical dome of the vibrating plate 12 so as to increase the mass of the yoke 14 and hence the mass of the magnetic circuit composition 19, so that the vibrating energy of the magnetic circuit composition 19 may be increased. The underside of the yoke 14 of FIG. 2 is thickened for the same purpose as that of the magnetic circuit composition 19 of FIG. 1.

As shown in FIGS. 1 and 2, a hole 20*b* is formed in each coil holding plate 20 (20*a*) so as to allow the vibration of the vibrating plate 12 and the magnetic circuit composition 19. It is possible to form the inside space defined by the vibrating plate 12 and the coil holding plate 20 in the case 11 into a resonance room. By adjusting the opening area at the hole 20*b*, the resonance characteristic can be controlled.

In the above described embodiments, the driving signal is applied to the coil 13 (13*a*) or coil 21 (21*a*) by changing over the circuit for the driving signal, thereby separately operating either of the vibrating plate 12 or the magnetic circuit composition 19. Furthermore, it is possible that driving signals for exciting respective coils 13 and 21 are applied to both coils at the same time, thereby vibrating both of the vibrating plate 12 and the magnetic circuit composition 19. Thus, calling sounds by the vibrating plate 12 and calling vibration of the instrument body are generated at the same time. Therefore, it is possible to ensure the user's attention to the calling.

If an exciting current is applied to the voice coil 13 so that the vibrating plate 12 can be held at a position far from the magnetic circuit composition due to the magnetic operation of the magnetic field of the magnetic circuit composition 19, while the magnetic circuit composition 19 is vibrated by the exciting current flowing in the coil 21. Such a means enables to reduce the distance between the vibrating plate 12 and the magnetic circuit composition. Thus, it is possible to reduce the thickness of the multiple-function convertor.

In accordance with the present invention, there is provided two independent coils for driving the voice coil and for driving the magnetic circuit composition. Therefore, it is possible to vibrate only the voice coil or the magnetic circuit composition by supplying the driving current to the corresponding coil, thereby preventing the collision between the voice coil and the magnetic circuit composition. Consequently, the thickness of the multiple-function convertor can be reduced.

Furthermore, the voice coil and the magnetic circuit composition can be vibrated at the same time so as to generate calling sounds and calling vibration of parts of the multiple-function convertor at the same time.

While the invention has been described in conjunction with preferred specific embodiment thereof, it will be understood that this description is intended to illustrate and not limit the scope of the invention, which is defined by the following claims.

What is claimed is:

1. A multi-function convertor for a portable electronic instrument comprising:

a case for mounting components of the electronic instrument;

a vibrating plate securely mounted in the case at one of axial ends of the case;

an annular first coil secured to the vibrating plate;

a magnetic circuit composition mounted in the case, the magnetic circuit composition comprising a yoke having a flange and a core formed on the flange, an annular magnet mounted on the flange of the yoke at one of poles thereof, and a top plate comprising an annular portion and a cylindrical portion projected from a peripheral portion of the annular portion, the annular portion being engaged with the other magnetic pole of the magnet;

supporting means for resiliently supporting the magnetic circuit composition in the case;

a coil holding plate secured to the case at the other axial end of the case;

an annular second coil secured to the coil holding plate;

the first coil being inserted in a first magnetic gap formed in the magnetic circuit composition at one of axial end sides thereof, and the second coil being inserted in a second magnetic gap formed in the magnetic circuit composition at the other axial end side thereof;

means for independently applying electric exciting current to the first coil and second coil.

2. The convertor according to claim 1 wherein the cylindrical portion of the top plate is provided for surrounding the periphery of the magnet.

3. The convertor according to claim 1 wherein the supporting means comprises a pair of annular supporting spring plates one of which is secured between a base of the cylindrical portion of the top plate and the case, and the other of which is secured between an end portion of the cylindrical portion and the case.

4. The convertor according to claim 1 wherein said means is provided for applying a first current to the first coil so as to vibrate the vibrating plate, and for applying a second current to the second coil so as to vibrate the magnetic circuit composition.

5. The convertor according to claim 4 wherein either of the first current and the second current is applied to a corresponding coil.

6. The convertor according to claim 4 wherein the first current and the second current are applied to first and second coils at the same time.

7. The convertor according to claim 6 wherein the first current is applied to the first coil so as to hold the vibrating plate at a position far from the magnetic circuit composition.

* * * * *